US005350305A

United States Patent [19]

Pidancet

[11] Patent Number: 5,350,305

[45] Date of Patent: Sep. 27, 1994

[54] COMBINATION LAMP AND SOCKET

[75] Inventor: Jean Pidancet, Besancon, France

[73] Assignee: Socop, S.A., Besancon, France

[21] Appl. No.: 847,020

[22] PCT Filed: Aug. 8, 1991

[86] PCT No.: PCT/FR91/00655

§ 371 Date: Apr. 30, 1992

§ 102(e) Date: Apr. 30, 1992

[87] PCT Pub. No.: WO92/03685

PCT Pub. Date: Mar. 5, 1992

[30] Foreign Application Priority Data

Aug. 16, 1990 [FR] France ..... 90 10505

[51] Int. Cl.[5] ..... H01R 33/09

[52] U.S. Cl. ..... 439/56; 439/619

[58] Field of Search ..... 439/56, 57, 58, 547, 439/554, 558, 699, 619; 362/226, 800; 313/318

[56] References Cited

U.S. PATENT DOCUMENTS

| | | | |
|---|---|---|---|
| 2,888,658 | 5/1959 | Welch | 439/366 |
| 3,129,421 | 4/1964 | Freedman | 439/56 |
| 3,335,387 | 8/1967 | Mueller | 439/56 |
| 4,468,585 | 8/1984 | Beyland et al. | 313/318 |
| 4,571,016 | 2/1986 | Debrabander | 439/82 |
| 4,897,769 | 1/1990 | Lang | 362/226 |

FOREIGN PATENT DOCUMENTS

| | | |
|---|---|---|
| 0092489 | 10/1983 | European Pat. Off. . |
| 1119589 | 6/1956 | France . |
| 2123679 | 9/1972 | France . |
| 2200479 | 4/1974 | France . |
| 703626 | 2/1954 | United Kingdom . |

OTHER PUBLICATIONS

Product Engineering Design Manual, 12 Ways To Retain Electronic Tubes, p. 244, 1959.

*Primary Examiner*—Neil Abrams
*Attorney, Agent, or Firm*—Weiser & Associates

[57] ABSTRACT

Assembly of a lamp and of its support designed to be inserted into a printed circuit board or the like, characterised in that the lamp (2) is disposed on the support (1) perpendicularly to the axis of snapping the support home into the board, so that the lamp is parallel to the board in its position of use. The support (1) includes wires (5) that extend from the lamp and which are wound around the free ends of a resilient support beam (6) associated with the support (1). The support (1) includes snap catches (12, 13) for engaging the bottom of the board (14). The support (1) further includes a reflective surface (17) for achieving a gain in lighting supplied by the lamp (2).

12 Claims, 2 Drawing Sheets

COMBINATION LAMP AND SOCKET

BACKGROUND OF THE INVENTION

The present invention has as its subject an assembly of a lamp and a support designed, more particularly, to be inserted into a printed circuit board or the like.

Lamp supports and lamps of this type have been known per se for some time. They are used in particular in the automobile industry, in order to equip the dashboards of vehicles. Of course, their application is not strictly limited to this field.

Although the known products generally give satisfactory results, it became apparent that it was desirable and possible to improve their performance both in terms of their service life and the quality of the lighting provided.

SUMMARY OF THE INVENTION

The present invention therefore has the object of providing such an improved assembly of a lamp and of its support. The invention also has as its object a specific structure of an electrical connection capable of being produced by automated winding.

According to the invention an assembly of a lamp and of its support is provided which can be inserted into a printed circuit board or the like, characterised in that the lamp is disposed on the support perpendicular to the axis along which support is snapped into the board, so that the lamp (and also the filament) is parallel to the board in its position of use.

In all of the known devices of the prior art and of this known field, the lamps are parallel to the main axis of the support and to the axis along which the support is snapped into the board.

The invention will be better understood with the aid of the description of an embodiment given as a nonlimiting example with reference to the accompanying drawings.

DETAILED DESCRIPTION OF A PREFERRED EMBODIMENT

Figure 1:
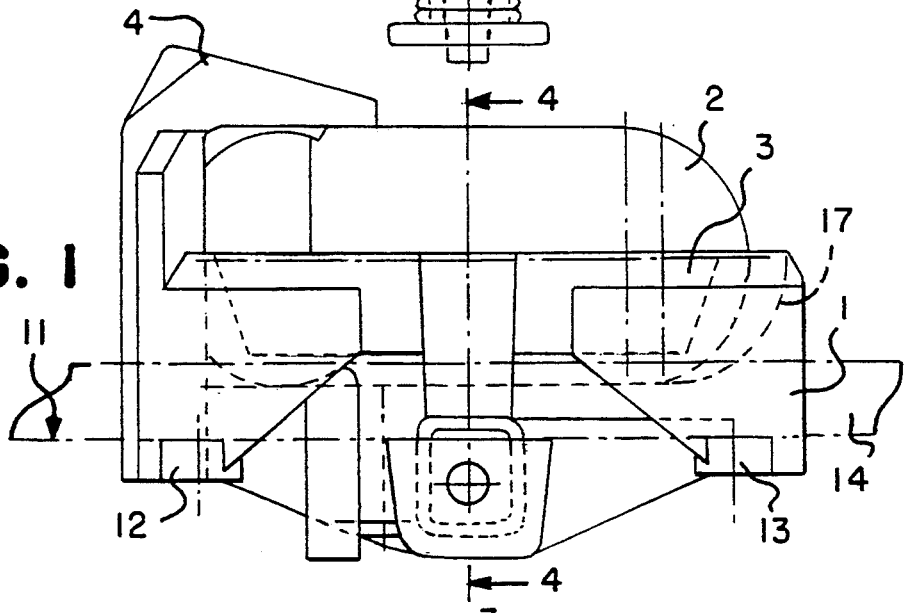
FIG. 1 is a side elevation view of a lamp support and of a lamp according to the invention.

Reference is made first to FIG. 1.

FIG. 1 shows the support (1) and the lamp (2) disposed in a horizontal position. The support comprises a table (3) for reception of the lamp which also serves as a reflector. The lamp is held in position by a clip (4) or by any other means.

Figure 2:
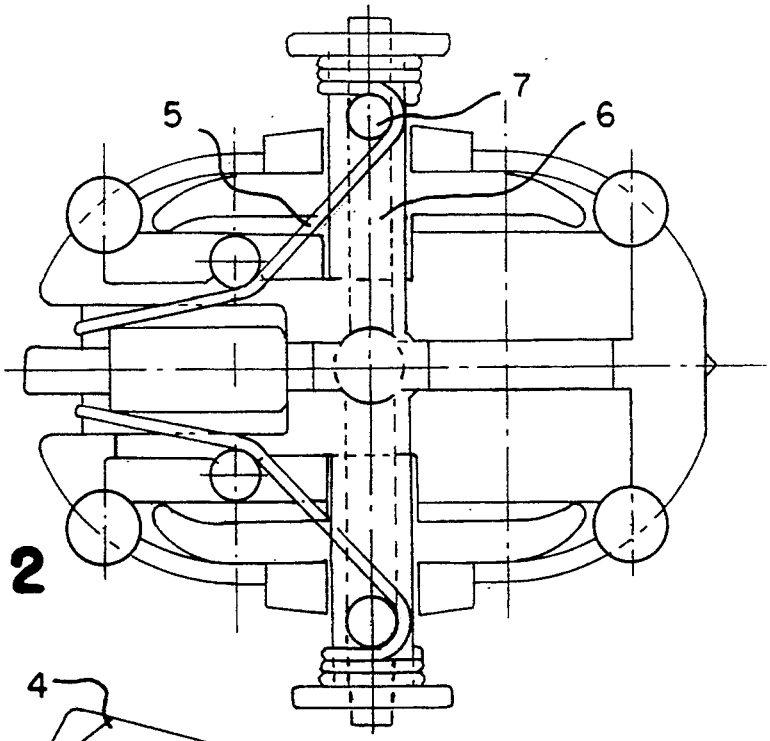
FIG. 2 is an inverted plan view of FIG. 1.
Figure 4:
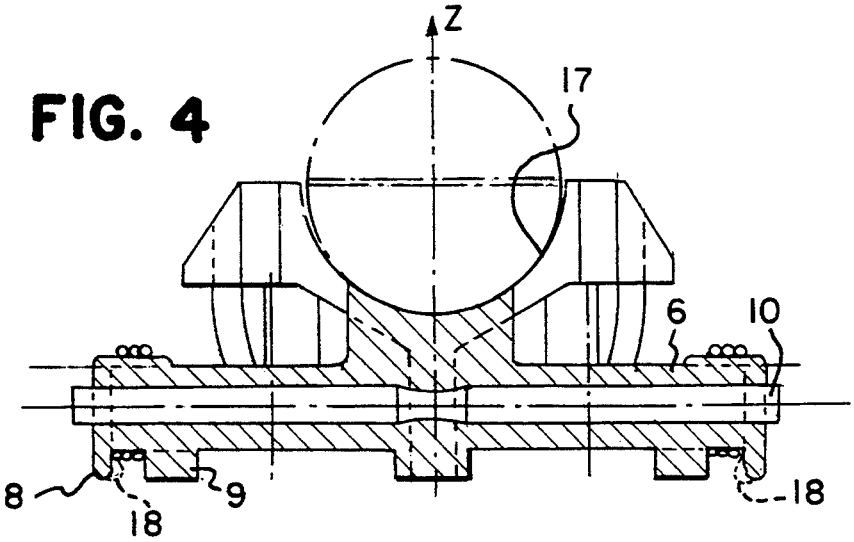
FIG. 4 is a sectional view along A—A of FIG. 1.
Figure 3:
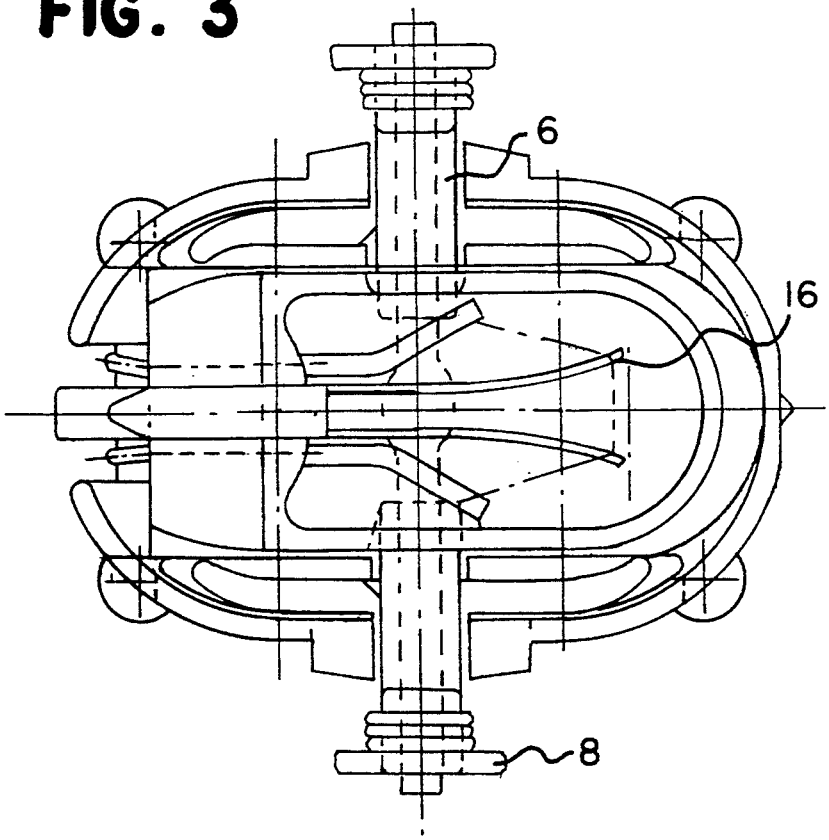
FIG. 3 is a plan view of FIG. 1.

The electrical connectors, shown in FIGS. 2 and 3, are formed as a wire (5) which extends toward the bottom of the support and which is wound at each of its ends onto the free ends of a resilient support beam (6). The windings may be executed in both directions around the beam, possibly with a change of direction by an angle reverse pin (7). The wires can, if desired, be wound between one or two flanges (8, 9) formed integrally with the beam, and may be securely attached to the beam by deformation (shown at (18) in FIG. 4) of at least one flange (e.g., by addition of material or by ultrasonic welding). For better stability against vibrations and flow, the beam (6) may incorporate a metal insert (10).

Figure 5:
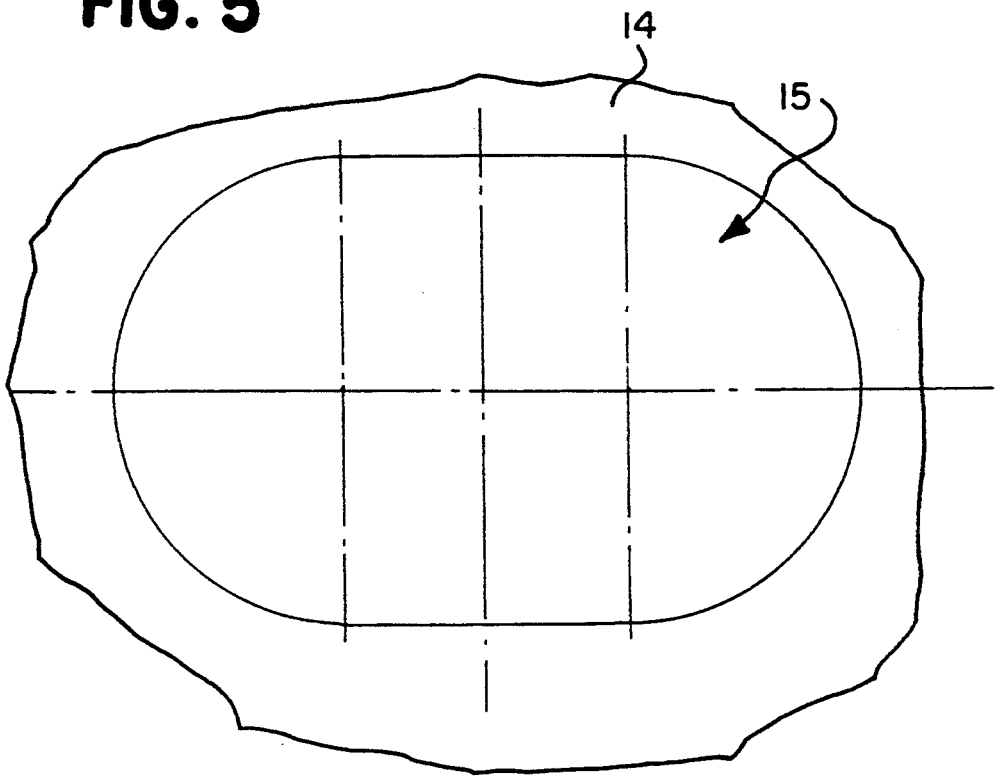
FIG. 5 is a plan view of a specific imprint for mounting the support of the invention in a printed circuit board.

Mounting will be effected in a printed circuit board at the level of the plane (11), with snap catches (12, 13) which come into abutment with the bottom of the board (14). The imprint (15) shown in FIG. 5 permits a simple snapping home, without rotation. However, it would also fall within the scope of the invention to provide a blocking connection by rotation (as is the case for most supports of the prior art).

This novel structure brings manifold advantages which, in a non-exhaustive manner, are discussed below.

1. Because the lamp is flat with respect to its support (and therefore to the board), the following benefits are drawn:
   - benefit of a larger visible area of the filament (16)
   - improvement of the lighting through a reflector effect on the surface (17) of the support. For this several possibilities are envisaged:
     - by the colour used in the support
     - with the aid of a glue loaded with reflective material
     - by metal plating
     - by the use of a metal reflector.

Each of these actions contributes to a gain in lighting, which may be up to four-fold. Such a gain enables the service life of the lamp to be increased as a result of lower stresses on it, or as a result of reduced energy levels. An improvement of the luminance/watt ratio is thus obtained.

Moreover, the overall dimension (height) in the direction of the Z axis (FIG. 4) for snapping home into the board is considerably reduced.

2. The shape of the electrical connection makes possible an automated winding, which without an intermediary, ensures the electrical connection between the lamp and the supply circuit, and permits connection to either face of the printed circuit, without preference.

The winding considerably reduces the voltage drops between the product and its supply circuit, namely the board (15).

3. Because of as regards the resilience of the support, the shape of the support permits over moulding of the resilient metal insert, thus avoiding the relaxation of the connection base. An electrical contact is thus ensured over time.

4. Because of the manner of locking the support, removal remains possible.

5. The mounting imprint (15) is symmetrical along its two axes. A device for preventing incorrect location therefore is not necessary, but is of course possible.

6. The forms of presentation of the support and of its lamp are multiple, that is to say they may be presented:
   - individually,
   - in batches of n units grouped linearly on the same support (10),
   - in a network of n units grouped on the same support (10) (the network may be flat or tiered and the support may or may not be covered by an overmoulded protection).

In addition, the support also makes it possible, with an adequate arrangement, to provide the ground function. Moreover, the support makes possible a strip supply of the product. Lastly, in a more general manner, the support of the invention is compatible with high density matrix implantation.

I claim:

1. An assembly comprising a lamp having a filament and a support having a base for insertion into a printed circuit board associated with a dashboard of a vehicle; wherein the support comprises a cradle for receiving the lamp and having a reflective surface for increasing luminescence of the lamp, and a clip for holding the lamp in position within the cradle; wherein the base is inserted into the printed circuit board along a home axis; wherein the lamp is disposed within the cradle of the support in a direction generally perpendicular to the home axis so that the lamp and the filament are substantially parallel to the printed circuit board; and wherein the support includes electrical connectors formed as wires which extend toward bottom portions of the support and which are wound onto free ends of a resilient support beam.

2. The assembly of claim 1 wherein the free ends are wound in both directions around the beam.

3. The assembly of claim 1 which includes an angle reverse pin for changing the direction of the wires.

4. The assembly of claim 1 wherein the wires are wound between flanges formed integrally with the beam.

5. The assembly of claim 4 wherein the wires are securely attached to the flanges by deformations formed in the flanges.

6. The assembly of claim 1 wherein the beam incorporates a metal insert.

7. The assembly of claim 1 wherein the printed circuit board includes a mounting area formed in the printed circuit board, and the assembly includes snap catches for engaging bottom portions of the printed circuit board at the mounting area.

8. The assembly of claim 1 wherein the cradle has a shape which conforms to the lamp, so that the reflective surface surrounds at least portions of the lamp.

9. An assembly comprising a lamp having a filament and a support having a base for insertion into a printed circuit board associated with a dashboard of a vehicle;

wherein the support comprises a cradle for receiving the lamp and having a reflective surface for increasing luminescence of the lamp, a clip for holding the lamp in position within the cradle, electrical connectors formed as wires which extend toward bottom portions of the support and which are wound onto free ends of a resilient support beam, and wire angle reversing pins for directing the wires along the bottom portions of the support and onto the free ends of the support beam;

wherein the printed circuit board includes a mounting area formed in the printed circuit board, the support includes snap catches for engaging bottom portions of the printed circuit board at the mounting area, and the base is inserted into the printed circuit board along a home axis; and wherein the lamp is disposed within the cradle of the support in a direction generally perpendicular to the home axis so that the lamp and the filament are substantially parallel to the printed circuit board.

10. The assembly of claim 9 wherein the cradle has a shape which conforms to the lamp, so that the reflective surface surrounds at least portions of the lamp.

11. The assembly of claim 10 wherein the wires are wound between flanges formed integrally with the beam.

12. The assembly of claim 11 wherein the wires are securely attached to the flanges by deformations formed in the flanges.

* * * * *